United States Patent [19]

Ruhl et al.

[11] 4,250,733

[45] Feb. 17, 1981

[54] FASTENING SYSTEM INCLUDING SEGMENTED SELF RELEASING ANVIL

[75] Inventors: John H. Ruhl, Tustin; Richard D. Dixon, El Toro, both of Calif.

[73] Assignee: Huck Manufacturing Company, Detroit, Mich.

[21] Appl. No.: 57,316

[22] Filed: Jul. 13, 1979

[51] Int. Cl.[3] ..... B21J 15/36

[52] U.S. Cl. ..... 72/391; 29/517; 72/402

[58] Field of Search ..... 72/402, 391, 412, 452, 72/476, 399, 367, 481; 29/243.52, 243.53, 243.54, 237, 517

[56] References Cited

U.S. PATENT DOCUMENTS

| | | | |
|---|---|---|---|
| 2,396,661 | 3/1946 | Keller | 85/37 |
| 2,764,045 | 9/1956 | Koenig | 72/481 |
| 3,029,665 | 4/1962 | Baugh | 72/391 |
| 3,122,948 | 3/1964 | Baugh | 72/391 |
| 3,143,903 | 8/1964 | Van Hecke | 72/391 |
| 3,329,000 | 7/1967 | Schwab | 72/391 |
| 3,603,132 | 9/1971 | Holmes | 72/402 |
| 3,638,472 | 2/1972 | Orloff | 72/391 |
| 3,689,951 | 9/1972 | Van Hecke | 72/391 |
| 3,834,011 | 9/1974 | Pinkerton | 29/517 |

*Primary Examiner*—Leon Gilden
*Assistant Examiner*—Gene P. Crosby
*Attorney, Agent, or Firm*—Harness, Dickey & Pierce

[57] ABSTRACT

A fastening system for setting stump type swage fasteners providing high fastener clamping force and low application loads and low removal loads of the associated tool; the associated tool anvil, comprising self releasing anvil segments, has a swage surface providing desired material flow to enhance fastener clamping force and also has relief grooves which inhibit galling and result in 'witness' lines providing a visual indication of proper setting of the fastener.

11 Claims, 9 Drawing Figures

FIG. 1.
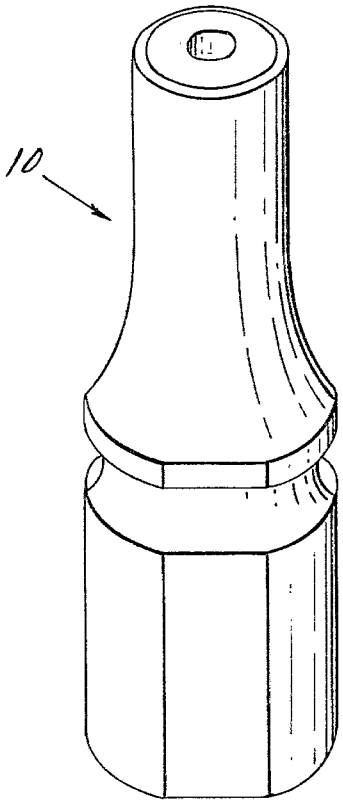
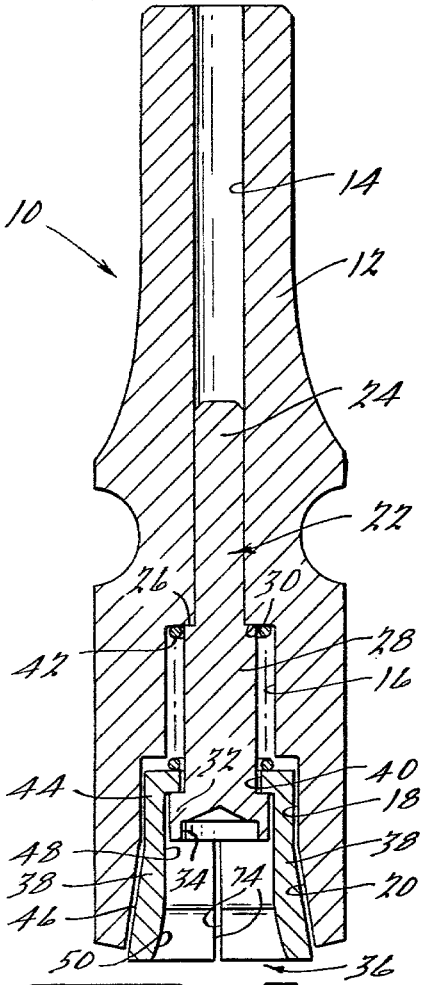
FIG. 2.
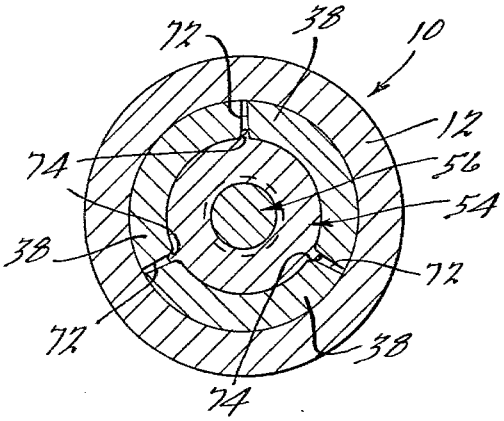
FIG. 8.
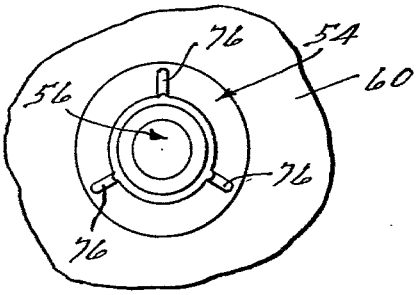
FIG. 9.

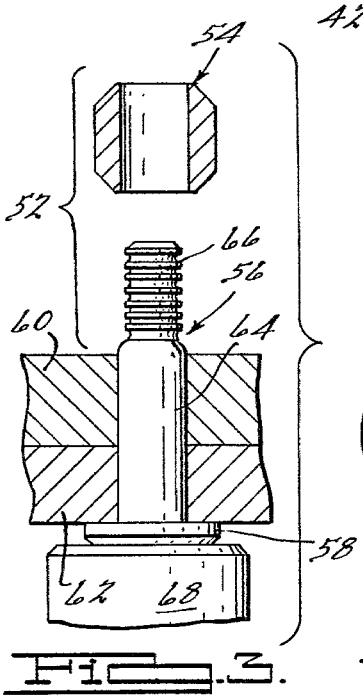
FIG. 3.
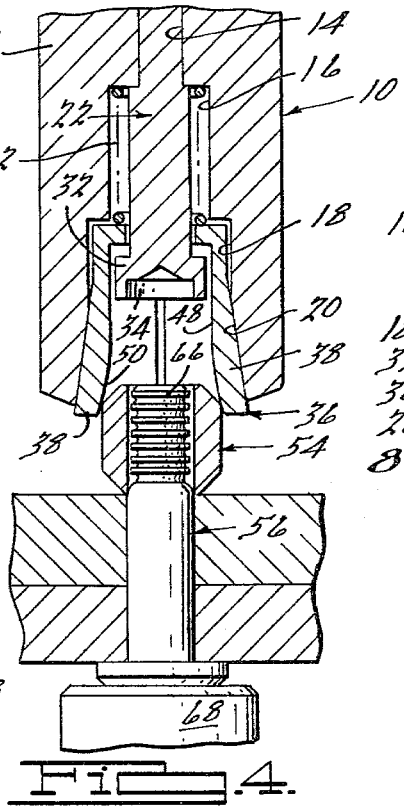
FIG. 4.
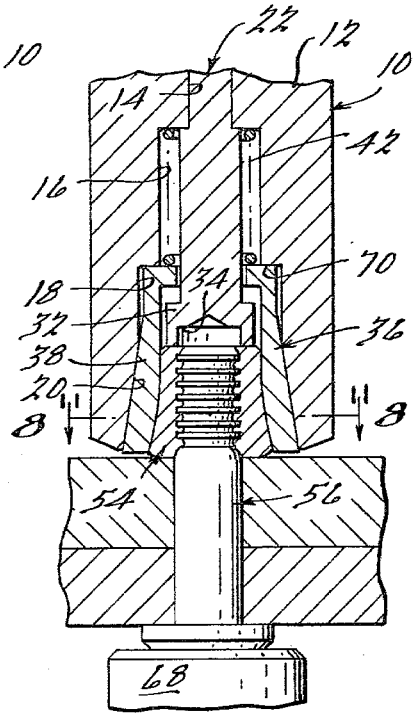
FIG. 5.
FIG. 6.
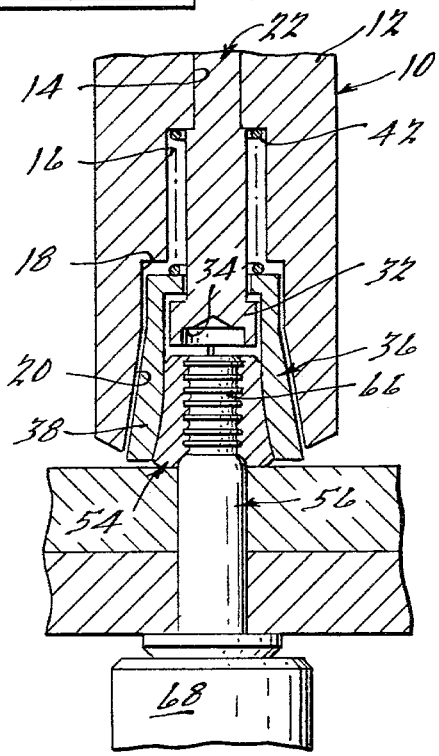
FIG. 7.
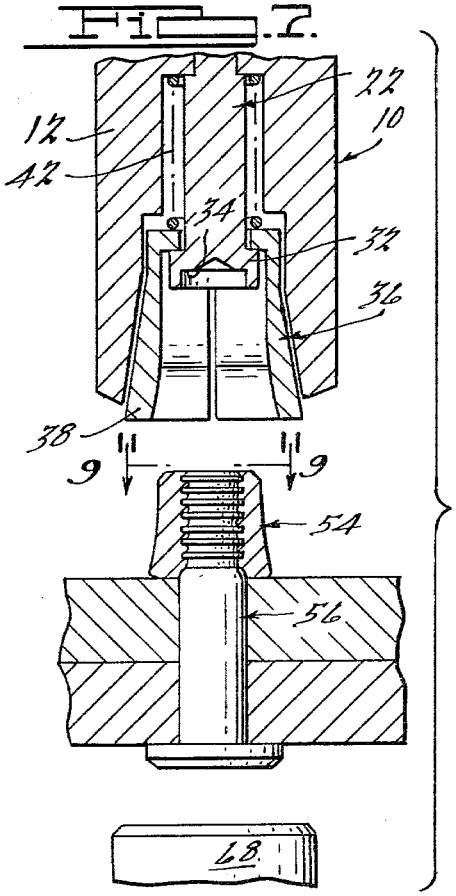

FASTENING SYSTEM INCLUDING SEGMENTED SELF RELEASING ANVIL

SUMMARY—BACKGROUND OF THE INVENTION

The present invention relates to a fastening system for providing a stump type swage fastener which is set with a high residual clamping force and for providing a novel tool for setting such fastener.

Stump type swage fasteners and tools for setting the same are generally shown in U.S. Pat. No. 2,396,661 issued to P. B. Keller, et al on Mar. 19, 1946, and 2,764,045 issued to P. C. Koenig on Sept. 25, 1956. With prior tools or devices for setting stump type swage fasteners the contour of the swage surface is such that resultant clamping loads of the set fastener are normally significantly less than would be obtained with a pull type swage fastener, i.e. of a type generally shown in U.S. Pat. No. 2,531,048 issued to L. C. Huck on Nov. 21, 1950. This occurs because the swage surface of the pull type tools has a more desirable contour whereby more metal can be advantageously moved to enhance clamping. (One form of pull gun for a pull type swage fastener and having a multi-pieced anvil with the desired swage surface contour is shown in U.S. Pat. No. 3,329,000 issued to C. J. Schwab on July 4, 1967.) One difficulty with some prior devices for setting the stump type swage fasteners has been in the high forces necessary to effect the swage. Another difficulty with other such devices has been the need for a relatively high force for removing the same from the swaged fastener. In these cases the desired swage surface contour cannot be readily used.

With the system of the present invention a device is utilized having a desired swage surface contour (similar to that of a pull type swage device) for setting stump type swage fasteners whereby a high clamping force is obtained and in which the application and removal loads are minimized. At the same time the provision of a relief angle or radius at the swaging surface of the device minimizes galling of the swaged surfaces on the fastener and results in visible axial lines providing a positive indication that the fastener has been properly set.

It should be understood that the phrase 'stump type swage fastener' refers to a two piece fastener including a pin and a sleeve in which the sleeve is swaged onto the pin without a relative pulling force applied between the pin and sleeve; this, of course, is in contrast to the pull type swage fastener previously referred to.

Other objects, features, and advantages of the present invention will become apparent from the subsequent description and the appended claims, taken in conjunction with the accompanying drawings, in which:

FIG. 1 is a pictorial view of a tool or swage device for setting stump type swage fasteners;

FIG. 2 is a longitudinal sectional view of the swage device of FIG. 1;

FIG. 3 is a plan view with some parts shown in section of a stump type swage fastener in a pre-set condition relative to a pair of workpieces to be secured together;

FIG. 4 is a view similar to FIG. 3 with the device of FIGS. 1 and 2 shown as initially applied to the fastener;

FIG. 5 is a view similar to FIG. 4 depicting the fastener and setting device in the completed, set position;

FIG. 6 is a view similar to FIG. 5 depicting the setting device as it is being removed from the set fastener;

FIG. 7 is a view similar to FIG. 6 depicting the setting device removed from the set fastener;

FIG. 8 is an enlarged sectional view taken in the direction of the lines 8—8 in FIG. 5 depicting the position of components of the setting device and the fastener in the set position; and FIG. 9 is a top elevational view to enlarged scale of the set fastener of FIG. 7 taken in the direction of the lines 9—9 in FIG. 7.

Looking now to the drawings FIGS. 1 and 2 depict a swaging tool or device 10 which includes an outer housing 12. The housing 12 is contoured to be accepted by hammer-drive type apparatus (not shown) whereby repeated blows can be applied to the device 10 by power actuated means known in the art. It should be noted that the features of the present invention can also be applied to hand powered installation tools as well as squeeze type installation tools.

The housing 12 has a central bore 14 which communicates with an intermediate enlarged bore 16 which in turn communicates with an enlarged end bore 18. The end bore 18 terminates at its outer end in an outwardly tapered or frusto-conically shaped bore portion 20.

A stop pin 22 having a stepped construction is secured within the housing 12 via an interference fit between a first portion 24 and central bore 14. The stop pin 22 is located at a preselected position in housing 12 via engagement of a shoulder 26, between the first portion 24 and an enlarged intermediate pin portion 28, and a stop surface 30 defined by the juncture of central bore 14 and intermediate bore 16. The intermediate pin portion 28 extends through intermediate bore 16 in a clearance relation and terminates in an enlarged head portion 32. The head portion 32 is located within end bore 18 and itself has a counterbore 34 which serves a purpose to be described.

A swage anvil assembly 36 comprises a plurality of separate anvil segments 38 which together define a generally bell shaped construction having a reduced diameter opening 40 at its inner end. The opening 40 is smaller than the diameter of head portion 32 of the stop pin 22 whereby the assembly 36 will be retained within the end bore 18. A coil spring 42 located in intermediate bore 16 and around intermediate pin portion 28 biases the anvil assembly 36 to its forwardmost position against the head portion under a relatively light preload.

The segments 38 together define an outer actuating surface and an inner swage surface. The outer surface has a straight surface portion 44 and a tapered or frusto-conical surface portion 46 which are generally complementary to and generally coextensive with the end bore 18 and bore portion 20. As can be seen from FIG. 2 in its non-actuated condition (and released condition as shown in FIG. 7) the surface portion 44 and 46 are in clearance relation with the end bore 18 and bore portion 20.

The inner swage surface defined by segments 38 include a generally straight portion 48 and a radially outwardly flared, bell mouth portion 50. The contour defined by this inner swage surface provides a desired swage characteristic whereby clamping force is enhanced.

The utilization of the device 10 in setting a fastener can best be seen in FIGS. 3–7. FIG. 3 shows a stump type fastener 52 which includes a tubular collar 54 and a pin member 56. The pin member 56 has an enlarged head 58 adapted to engage one side of workpieces 60 and 62 and a shank 64 which extends through aligned openings in the workpieces. The shank 64 terminates at its outer end in a plurality of locking grooves 66 which can be of a construction shown in U.S. Pat. No. 3,915,053 issued to J. H. Ruhl on Oct. 28, 1975, the disclosure of which is incorporated herein by reference. Note that the grooves 66 can be defined by separate annular grooves or by a helical construction. The collar 54 can be of a construction shown in copending U.S. Patent Application No. 889,860 filed on Mar. 24, 1978 for "Improved Stress Coining Collars and Lockbolt Construction", now U.S. Pat. No. 4,198,895, the disclosure of which is incorporated herein by reference.

In FIG. 4 the device 10 is shown as initially applied to the collar 54, which has now been located over the locking grooves 66 of the pin 56. A bucking bar 68 is located against the head 58 of the pin 56 to provide support during the swaging operation which follows. The operator actuates the hammer-drive apparatus (not shown) which repetitively applied an impact to the device 10 via the coupling with the housing 12. As the swaging is initiated the segments 38 of the anvil assembly 36 are moved into the end bore 18 until they engage an enlarged stop shoulder 70 which is defined by the juncture of end bore 18 and intermediate bore 16. At the same time as the flared, bell mouth portion 50 is moved over the collar 54 the frusto-conical surface portion 46 of the anvil assembly 36 is moved into engagement with the complementarily shaped tapered bore portion 20. As will be seen in this position the anvil segments 38 are slightly spaced radially from each other. Continued impacting causes the anvil assembly 36 to move further over the collar 54 completing the swaging operation, (see FIG. 5). Note that when this occurs the collar 54 is moved at least partially within the straight portion 48 of the anvil swage surface. Since the straight portion 48 is of a reduced diameter the material of the collar 54 will be moved further resulting in additional collar and pin enlongation which in turn increases the relative tensile force on the pin 56 whereby the clamping force on the workpieces 60 and 62 is increased. The straight portion 48 extends for approximately one half the length of the collar 54 in order to promote the noted collar elongation and desired increase in clamping force. Note that the bell mouth portion 50 and straight portion 48 define a swage surface which extends for the full length of surface to be swaged on the collar 54 thereby positively confining the collar 54 during swaging to promote the desired material flow.

In order to prevent over-driving of the device 10 and impacting against the outer surface of the workpiece 60, the head portion 32 is located at a preselected position within the end bore 18 and further within the straight bore portion 48 such as to engage the end of the collar 54 before the end of the housing 12 can engage the workpiece 60. The counterbore 34 is provided to receive the end of the pin 56 in the event it protrudes slightly past the end of collar 54.

In order to permit ease of releasing the anvil assembly 36 from the collar 54 after swaging, the tapers on the mating surfaces of the tapered bore portion 20 and on the frusto-conical surface portion 46 are provided with a desired release angle which can be approximately 7°. With this release angle, the housing 12 can be easily moved axially relative to the anvil assembly 36. As this occurs, the anvil segments 38 can now move radially away from the swaged collar 54 (see FIG. 6) and are thereby released therefrom.

Galling of the anvil segments 38 is precluded by providing a relief taper 72 (see FIG. 8) between confronting surfaces on adjacent anvil segments 38. Also the inner edges 74, extending longitudinally for the length of anvil segments 38 are provided with a radius. In many applications a protective coating (such as by anodizing) is provided on the collar 54. With the construction of the present invention including the relief taper 72 and radiused edges 74 scoring and/or galling of the coating is minimized.

The spacing between anvil segments 38 is essentially provided by the relief taper 72. This spacing is maintained at a minimum in order that no appreciable collar material flow occurs therein, thus maintaining the desired volume of collar material for filling the lock grooves 66 and for providing the desired elongation to give the high clamping force. The swaged collar, however, will have resultant ridges 76 (FIGS. 8 and 9) extending longitudinally for the extent of the swage. These ridges 76, while slight in volume of material, are still visible. Thus the ridges 76 provide a clear and easy indication to an inspector that the complete swage has been accomplished. The use of three or more anvil segments 38 not only facilitates inspection via ridges 76 but also assists in removal from the finally swaged collar 54.

While it will be apparent that the preferred embodiments of the invention disclosed are well calculated to fulfill the objects above stated, it will be appreciated that the invention is susceptible to modification, variation and change without departing from the proper scope or fair meaning of the invention.

We claim:

1. In a device for swaging a stump type fastener for clamping a plurality of workpieces together and including a pin and a tubular member adapted to be swaged onto the pin, said device swaging the tubular member onto the pin substantially by applying a force solely onto the tubular member, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage the tubular member a preselected amount to provide a desired clamping force on the workpieces via the set fastener, said inner swaging surface being of a length to confiningly embrace the tubular member for substantially its entire swaged length with said tubular member being swaged over a substantial portion by said straight cylindrical portion, a stop pin supported in said housing and having an enlarged head portion for supporting said anvil segments in their non-actuated position spaced from said tapered opening, spring means operative between said housing and said anvil segments for normally biasing said anvil segments axially outwardly against said head portion at a preselected preload, said anvil segments upon application on the tubular member being movable axially inwardly into said tapered opening with said outer frusto-conical surface engaging said tapered opening, anvil stop means cooperating with said housing and said anvil segments for limiting the axially inward movement of said anvil segments, said stop pin located at a preselected location to engage the fastener upon completion of the swaging at a position precluding said device from directly engaging the confronting one of the workpiece, said anvil segments having confronting side surfaces on adjacent ones of said anvil segments tapering radially inwardly away from each other whereby a slight axially extending gap occurs between adjacent ones of said anvil segments, said side surfaces terminating at their radially inner ends in axially extending edges which are radiused, said gaps receiving limited amounts of material from the tubular member upon swaging but providing readily visible lines extending axially for the length of the swage on the tubular member to provide observable inspection markings.

2. The device of claim 1 with said anvil means including at least three said anvil segments.

3. In a device for swaging a stump type fastener for clamping a plurality of workpieces together and including a pin and a tubular member adapted to be swaged onto the pin, said device swaging the tubular member onto the pin substantially by applying a force solely onto the tubular member, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage the tubular member a preselected amount to provide a desired clamping force on the workpieces via the set fastener, said inner swaging surface being of a length to confiningly embrace the tubular member for substantially its entire swaged length with said tubular member being swaged over a substantial portion by said straight cylindrical portion, said anvil segments upon application on the tubular member being movable axially inwardly into said tapered opening with said outer frusto-conical surface engaging said tapered opening, stop means located at a preselected location to engage the fastener upon completion of the swaging at a position precluding said device from directly engaging the confronting one of the workpieces.

4. In a device for swaging a stump type fastener for clamping a plurality of workpieces together and including a pin and a tubular member adapted to be swaged onto the pin, said device swaging the tubular member onto the pin substantially by applying a force solely onto the tubular member, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage the tubular member a preselected amount to provide a desired clamping force on the workpieces via the set fastener, said inner swaging surface being of a length to confiningly embrace the tubular member for substantially its entire swaged length with said tubular member being swaged over a substantial portion by said straight cylindrical portion, support means for supporting said anvil segments in their non-actuated position spaced from said tapered opening, said anvil segments upon application on the tubular member being movable axially inwardly into said tapered opening with said outer frusto-conical surface engaging said tapered opening, anvil stop means cooperating with said housing and said anvil segments for limiting the axially inward movement of said anvil segments, stop means located at a preselected location to engage the fastener upon completing of the swaging at a position precluding said device from directly engaging the confronting one of the workpieces.

5. The device of claim 4 with said support means including said stop means and comprising a stop pin member having an enlarged head portion operable to support said anvil segments and to engage the fastener.

6. The device of claim 5 with said stop pin member having a stop surface surrounding a counterbore whereby the tubular member will be engaged by said stop surface while the pin will be accepted into said counterbore.

7. In a device for swaging a stump type fastener for clamping a plurality of workpieces together and including a pin and a tubular member adapted to be swaged onto the pin, said device swaging the tubular member onto the pin substantially by applying a force solely onto the tubular member, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage the tubular member a preselected amount to provide a desired clamping force on the workpieces via the set fastener, said anvil segments upon application on the tubular member being movable axially inwardly into said tapered opening with said outer frusto-conical surface engaging said tapered opening, said anvil segments having confronting side surfaces on adjacent ones of said anvil segments tapering radially inwardly away from each other whereby a slight axially extending gap occurs between adjacent ones of said anvil segments, said side surfaces terminating at their radially inner ends in axially extending edges which are radiused, said gaps receiving limited amounts of material from the tubular member upon swaging but providing readily visible lines extending axially for the length of the swage on the tubular member to provide observable inspection markings.

8. In a system for setting a stump type fastener and for clamping a plurality of workpieces together and with said fastener including a pin and a collar adapted to be swaged onto said pin, a device for swaging said collar member onto said pin substantially by applying a force solely onto said collar, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage said collar a preselected amount to provide a desired clamping force on the workpieces via the set fastener, said inner swaging surface being of a length to confiningly embrace said collar for substantially its entire swaged length with said collar being swaged over a substantial portion by said straight cylindrical portion, said anvil segments upon application on said collar being movable axially inwardly into said tapered opening with said outer frusto-conical surface engaging said tapered opening, said anvil segments having confronting side surfaces on adjacent ones of said anvil segments tapering radially inwardly away from each other whereby a slight axially extending gap occurs between adjacent ones of said anvil segments, said side surfaces terminating at their radially inner ends in axially extending edges which are radiused, said gaps receiving limited amounts of material from said collar upon swaging but providing readily visible lines extending axially for the length of the swage on said collar to provide observable inspection markings.

9. In a system for setting a stump type fastener and for clamping a plurality of workpieces together and with said fastener including a pin and a collar adapted to be swaged onto said pin, a device for swaging said collar onto said pin substantially by applying a force solely onto said collar, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage said collar a preselected amount to provide a desired clamping force on the workpieces via the set fastener, said inner swaging surface being of a length to confiningly embrace said collar for substantially its entire swaged length with said collar being swaged over a substantial portion by said straight cylindrical portion, said anvil segments upon application on said collar being movable axially inwardly into said tapered opening with said outer frusto-conical surface engaging said tapered opening, stop means located at a preselected location to engage said fastener upon completion of the swaging at a position precluding said device from directly engaging the confronting one of the workpieces, said anvil segments having confronting side surfaces on adjacent ones of said anvil segments tapering radially inwardly away from each other whereby a slight axially extending gap occurs between adjacent ones of said anvil segments, said side surfaces terminating at their radially inner ends in axially extending edges which are radiused, said gaps receiving limited amounts of material from said collar upon swaging but providing readily visible lines extending axially for the length of the swage on said collar to provide observable inspection markings.

10. In a system for setting a stump type fastener and for clamping a plurality of workpieces together and with said fastener including a pin and a collar adapted to be swaged onto said pin, a device for swaging said collar onto said pin substantially by applying a force solely onto said collar, said device comprising a housing having a tapered opening at one end, anvil means located within said opening for relative movement therein, said anvil means comprising a plurality of separate anvil segments, said anvil segments together defining an outer frusto-conical surface having a contour complementary with that of said tapered opening, said outer frusto-conical surface and said tapered opening being at an angle providing a self releasing taper, said anvil segments together defining an inner swaging surface comprising an outer outwardly flaring bell mouth portion communicating with a reduced diameter straight cylindrical portion, said inner swaging surface selected to swage said collar a preselected amount to provide a desired clamping force on the workpieces via the set fastener, said inner swaging surface being of a length to confiningly embrace said collar for substantially its entire swaged length, with said collar being swaged for approximately one half of its length by said straight cylindrical portion, said anvil segments upon application on said collar being movable axially inwardly into said tapered opening with said outer frusto-conical surface engaging said tapered opening, stop means located at a preselected location to engage said fastener upon completion of the swaging at a position precluding said device from directly engaging the confronting one of the workpieces, said anvil segments having confronting side surfaces on adjacent ones of said anvil segments tapering radially inwardly away from each other whereby a slight axially extending gap occurs between adjacent ones of said anvil segments, said side surfaces terminating at their radially inner ends in axially extending edges which are radiused, said gaps receiving limited amounts of material from said collar upon swaging but providing readily visible lines extending axially for the length of the swage on said collar to provide observable inspection markings.

11. The system of claim 10 with said anvil means including at least three said anvil segments.

* * * * *